US008636533B1

(12) United States Patent
Yen

(10) Patent No.: US 8,636,533 B1
(45) Date of Patent: Jan. 28, 2014

(54) LED-LAMP-BOARD CONNECTOR

(76) Inventor: Hsu Li Yen, Taipei County (TW)

( * ) Notice: Subject to any disclaimer, the term of this patent is extended or adjusted under 35 U.S.C. 154(b) by 0 days.

(21) Appl. No.: 13/569,255

(22) Filed: Aug. 8, 2012

(51) Int. Cl.
*H01R 13/62* (2006.01)

(52) U.S. Cl.
USPC ..... 439/325; 439/636

(58) Field of Classification Search
USPC ..... 439/325, 327, 59, 636
See application file for complete search history.

(56) References Cited

U.S. PATENT DOCUMENTS 6,015,310 A * 1/2000 Tojo ..... 439/260
6,688,899 B2 * 2/2004 Rumpel ..... 439/188
6,932,659 B1 * 8/2005 Wong ..... 439/853
8,444,427 B2 * 5/2013 Hashimoto ..... 439/325

* cited by examiner

*Primary Examiner* — Hien Vu
(74) *Attorney, Agent, or Firm* — Rosenberg, Klein & Lee

(57) ABSTRACT

An improved LED-lamp-board connector includes a main housing having a base having terminal sockets. The base has two laterals formed with arms each separated from the base by a gap. The arms are provided with rabbets. The two arms are connected by a spine. The spine also has plural rabbets corresponding to the terminal sockets on the base. Each of plural terminals has a horizontal plate whose two ends each extended with a spring contacting piece. The horizontal plate has a lateral including an insert to be inserted into the rabbet on the spine or on the arm, making the horizontal plate and the spring contacting piece of the terminal received in the corresponding terminal socket on the base, thereby forming the connector. The connector receives two LED lamp boards inserted to its two ends, thereby forming an LED lamp board assembly of a variable length.

2 Claims, 6 Drawing Sheets

LED-LAMP-BOARD CONNECTOR

BACKGROUND OF THE INVENTION

1. Technical Field

The present invention relates to an improved LED-lamp-board connector, which is useful to physically and electrically connect LED lamp boards to form a length-variable LED lighting apparatus.

2. Description of Related Art

Referring to FIG. 1, generally, an LED lamp board 20 is made to have a fixed size and has two ends thereof equipped with conductive terminals 21. The LED lamp board 20 is then enclosed in a transparent tube 22 and between two end caps 23 to form an LED tubular lamp 200.

To make an LED tubular lamp of a varied length, it is necessary to provide a conductive board between two LED lamp boards 20 that electrically connects contacts of the two LED lamp board 20 and then solder the conductive board and the LED lamp boards 20 together, thereby serially connecting the LED lamp boards 20 and changing the length of the assembly of the LED lamp boards 20. However, such an approach is relatively labor- and time-consuming.

SUMMARY OF THE INVENTION

In view of the shortcomings of the prior art, the inventor tried to implement his years of experience in the art to devise a simplified structure to serially connect LED lamp boards, and after many experiments as well as improvements, the improved structure proposed herein has been finally invented.

An improved LED-lamp-board connector primarily comprises a main housing that has a base formed with a plurality of terminal sockets extending therethrough. The base has two opposite laterals thereof formed with arms each separated from the base by a gap. The arms are provided with rabbets. The two arms are connected by a spine. The spine also has plural rabbets corresponding to the terminal sockets on the base. There are plural terminals. Each said terminal has a horizontal plate whose two ends each extended with a ←shaped spring contacting piece. The horizontal plate has a lateral extended and bent upward to form an insert, whose bottom is formed with two projecting hooks. The insert of the terminal is configured to be inserted into and positioned by the rabbet on the spine or on the arm, such that the horizontal plate and the spring contacting piece of the terminal are received in the corresponding terminal socket on the base, thereby forming the connector. The connector so formed can receive two LED lamp boards inserted to its two opposite ends, thereby forming an LED lamp board assembly of a variable length.

The objective of the present invention is to provide the improved connector that is useful to physically and electrically connect two LED lamp boards in series rapidly.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
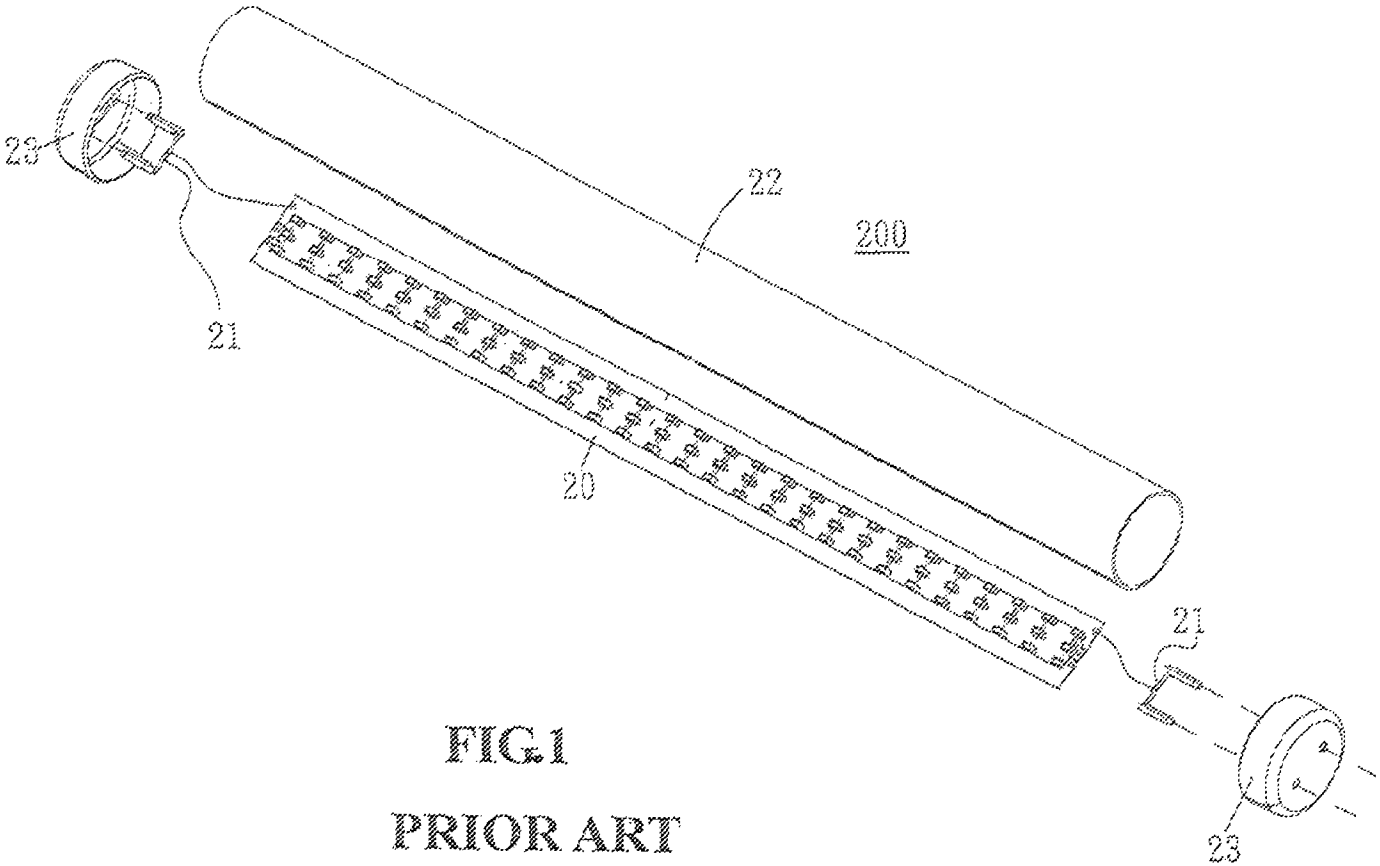
FIG 1 PRIOR ART
FIG. 1 is a schematic drawing of a conventional LED tubular lamp.
Figure 2:
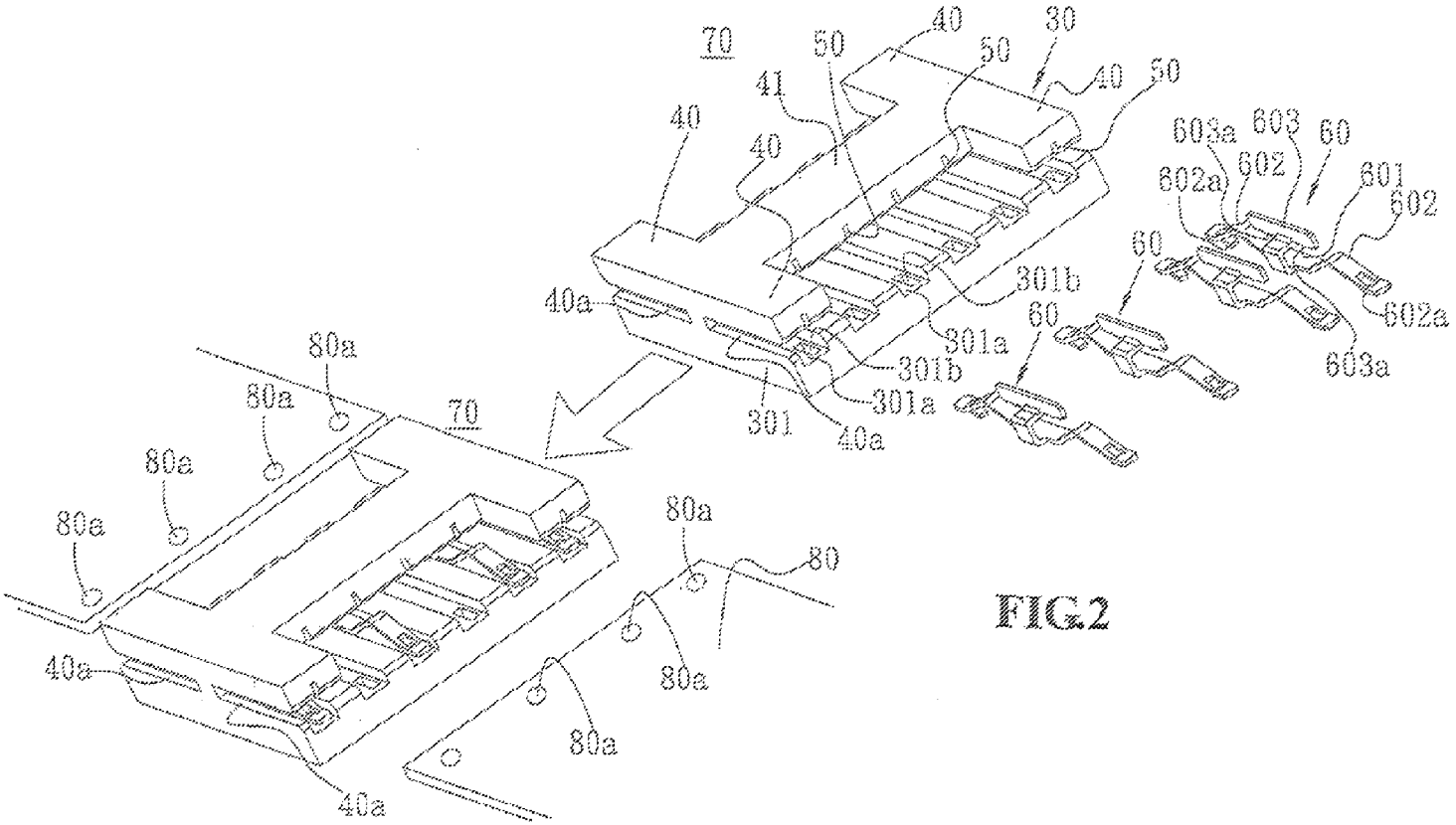
FIG. 2 is an exploded view of an improved LED-lamp-board connector according to one embodiment of the present invention.

FIG. 2 is an exploded view of an improved LED-lamp-board connector according to one embodiment of the present invention. As shown, the connector comprises a main housing 30 having a base 301 formed with a plurality of terminal sockets 301*a*, wherein each said terminal socket 301*a* has each of its front and rear ends formed with a positioning hole 301*b*. The base 301 also at its opposite laterals has arms 40 extending towards its opposite two ends from its axis such that each said arm 40 and the base 301 are separated by a gap 40*a*. Each of the arms 40 has a rabbet 50. The arms 40 at the two opposite laterals are connected by a spine 41, wherein the spine 41 is formed with a plurality of rabbet 50 each corresponding to one of the terminal sockets 301*a* of the base 301.

In addition, there are plural terminals 60. The terminal 60 is a horizontal plate 601 having two ends thereof each extended with a ←shaped spring contacting piece 602. The spring contacting piece 602 has a downward bent hook 602*a*. Also, one lateral of the horizontal plate 601 is extended and bent upward to form an insert 603, whose bottom is formed with two projecting hooks 603*a*. The insert 603 of the terminal 60 is configured to be inserted into and held by the rabbet 50 on the spine 41 or on the arm 40 such that the horizontal plate 601 and the spring contacting piece 602 of the terminal 60 are set in the terminal socket 301*a* on the base 301, with the hook 602*a* of the spring contacting piece 602 retained by the positioning hole 301*b* of the terminal socket 301*a*, thereby preventing the terminal 60 from displacement and acting as a connector 70.

Figure 3:
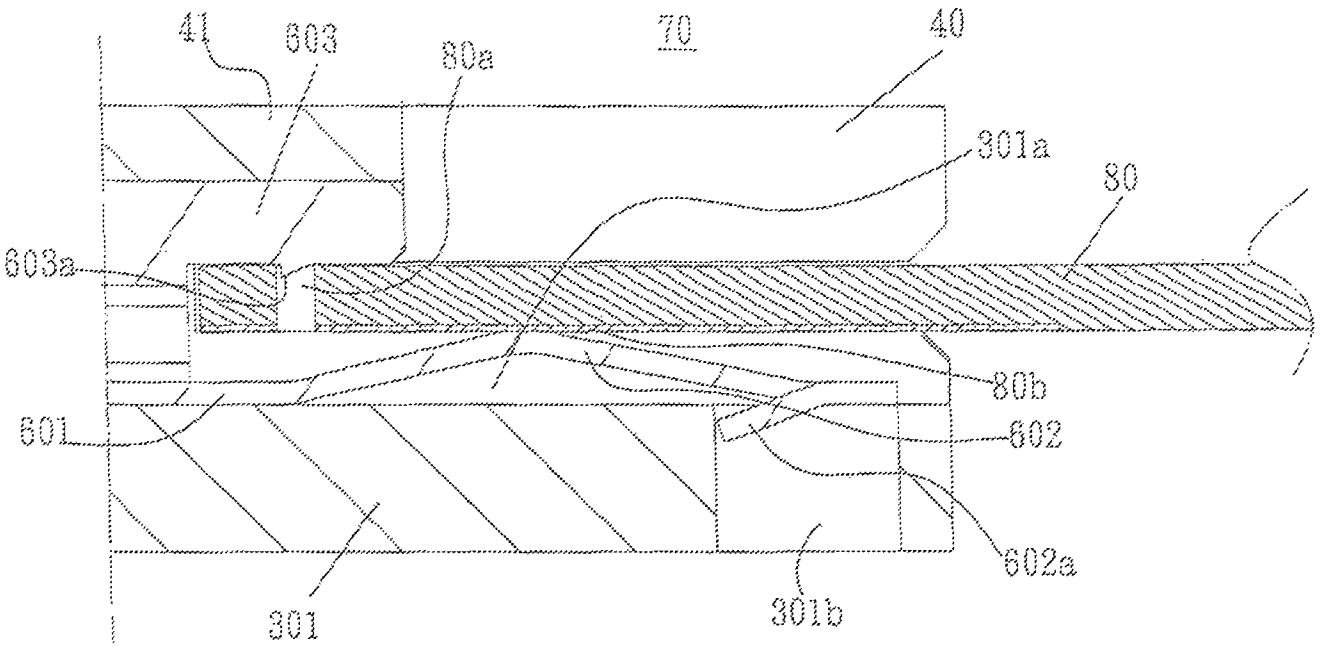
FIG. 3 is a cross-sectional view of the connector holding an LED lamp board.

The gaps 40*a* between the arms 40 and the base 301 at two opposite ends of the connector 70 accommodate two LED lamp boards 80 therein (referring to FIGS. 2 and 3) such that the projecting hook 603*a* of the insert 603 of the terminal 60 can be inserted into the through hole 80*a* of the corresponding LED lamp board 80 and that the conductive surface 80*b* at the bottom of the LED lamp board 80 presses against the spring contacting pieces 602 of the terminals 60, thereby electrically connecting the two LED lamp boards 80.

Figure 4:
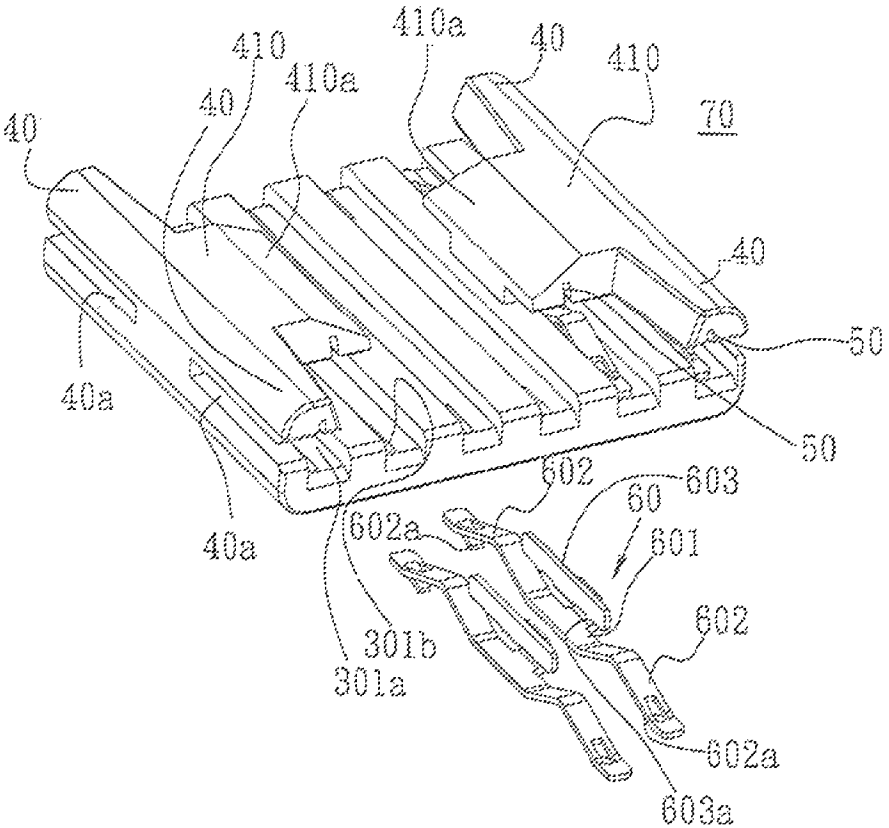
FIG. 4 is an exploded view of an improved LED-lamp-board connector according to another embodiment of the present invention.
Figure 6:
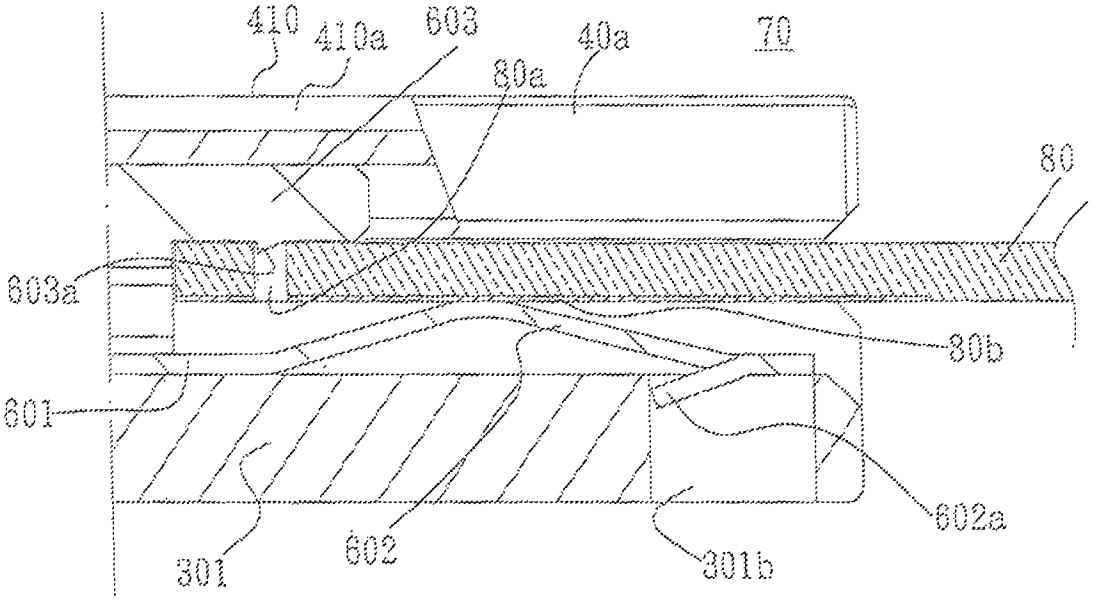
FIG. 6 is a cross-sectional view of the connector of the second embodiment holding an LED lamp board.

FIG. 4 is an exploded view of an improved LED-lamp-board connector according to another embodiment of the present invention. As shown, the connector has two arms 40 at its opposite laterals. Each of the arms 40 s formed with a spine 410 extending toward a center of the main housing 30. The two spines 410 are disconnected and each have a slope 410*a*. Therein, each of the spines 410 and the arms 40 is provided with a rabbet 50 corresponding to one said terminal socket 301*a* on the base 301 (also referring to FIG. 6) so that each said rabbet 50 allows the insert 603 of none said terminal 60 to be inserted to the spine 41 or the arms 40, and that the horizontal plate 601 and the spring contacting piece 602 of the terminal 60 can be positioned in the corresponding terminal socket 301*a* on the base 301, with the hook 602*a* of the spring contacting piece 602 engaged and positioned by the positioning hole 301*b* of the terminal socket 301*a*.

Figure 5:
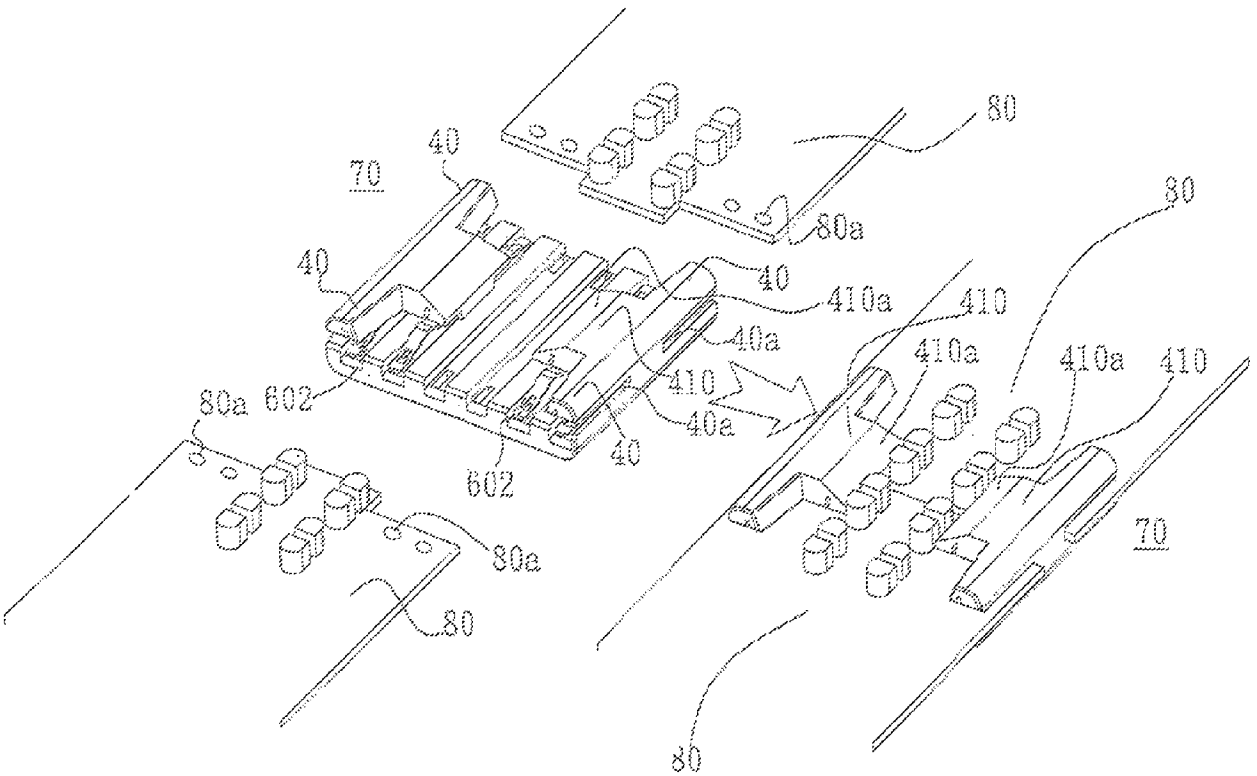
FIG. 5 is an applied view of the connector according to the second embodiment of the present invention.

The gaps 40*a* between the arms 40 and the base 301 at two opposite ends of the connector 70 accommodate two LED lamp boards 80 therein (referring to FIGS. 5 and 6) such that the projecting hook 603*a* of the insert 603 of the terminal 60 can be inserted into the through hole 80*a* of the corresponding LED lamp board 80 and that the conductive surface 80*b* at the bottom of the LED lamp board 80 presses against the spring contacting pieces 602 of the terminals 60, thereby electrically connecting the two LED lamp boards 80. Furthermore, disconnection between the two spines 410 and the slopes 410*a* on the spines 410 are designed to prevent from obstructing light.

What is claimed is:

1. An improved LED-lamp-board connector, being characterized in:

a main housing having a base formed with a plurality of terminal receiving recesses, each said terminal receiving recess having front and rear ends thereof formed with a positioning hole, the base having two laterals thereof provided with arms that extend from an axis of the base toward two opposite ends of the base, each said arm being separated from the base by a gap, each said arm having a rabbet, the arms at the two laterals being connected by a spine, and the spine having plural rabbets each corresponding to one said terminal receiving recess on the base; and a plurality of conductive terminals, each said terminal having a horizontal plate with two opposite ends thereof extended with a ←shaped spring contacting piece, the spring contacting piece having a downward bent hook, the horizontal plate having a lateral extended and bent upward to form an insert, the insert having a bottom formed with two projecting hooks, and the insert of the terminal being configured to be inserted into and positioned by the rabbet on the spine or on the arm such that the horizontal plate and the spring contacting piece of the terminal are received in the corresponding terminal receiving recess on the base with the hook of the spring contacting piece engaged with and positioned by the positioning hole of the terminal receiving recess thereby preventing the terminal from displacement and forming the connector;

thereby the gaps between the arms and the base at the two opposite ends of the connector allowing two LED lamp boards to be inserted thereinto and get serially connected with each other, such that the projecting hooks of the insert of each said terminal are engaged with one through hole formed on the inserted LED lamp board, and that a conductive surface at a bottom of each said LED lamp board presses against the spring contacting pieces of the terminal, thus making the inserted LED lamp boards physically and electrically connected rapidly.

2. An improved LED-lamp-board connector, being characterized in a main housing having a base formed with a plurality of terminal receiving recesses extending therethrough, each said terminal receiving recess having front and rear ends thereof formed with a positioning hole, the base having two laterals thereof provided with arms that extend from an axis of the base toward two opposite ends of the base, each said arm being separated from the base by a gap, each said arm having a rabbet, the arms at the two laterals of the base each having a spine extending toward a center of the base such that the two spine are disconnected, each said spine having a slope, and the spine having plural rabbets each corresponding to one said terminal receiving recess on the base; and a plurality of conductive terminals, each said terminal having a horizontal plate with two opposite ends thereof extended with a ←shaped spring contacting piece, the spring contacting piece having a downward bent hook, the horizontal plate having a lateral extended and bent upward to form an insert, the insert having a bottom formed with two projecting hooks, and the insert of the terminal being configured to be inserted into and positioned by the rabbet on the spine or on the arm such that the horizontal plate and the spring contacting piece of the terminal are received in the corresponding terminal receiving recess on the base with the hook of the spring contacting piece engaged with and positioned by the positioning hole of the terminal receiving recess, thereby preventing the terminal from displacement and forming the connector;

thereby the gaps between the arms and the base at the two opposite ends of the connector allowing two LED lamp boards to be inserted thereinto and get serially connected with each other, such that the projecting hooks of the insert of each said terminal are engaged with one through hole formed on the inserted LED lamp board, and that a conductive surface at a bottom of each said LED lamp board presses against the spring contacting pieces of the terminal, thus making the inserted LED) lamp boards physically and electrically connected rapidly, wherein disconnection between the two spines and the slopes on the spines are designed to prevent from obstructing light.

* * * * *